US007036924B2

(12) United States Patent
Kaieda et al.

(10) Patent No.: US 7,036,924 B2
(45) Date of Patent: May 2, 2006

(54) PROTECTIVE LAYER-TRANSFERRING FILM FOR INK JET RECORDED MATTER

(75) Inventors: Teruaki Kaieda, Nagano (JP); Masahiro Hanmura, Nagano (JP); Hajime Mizutani, Nagano (JP); Hiroyuki Onishi, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 10/435,941

(22) Filed: May 12, 2003

(65) Prior Publication Data

US 2004/0027436 A1 Feb. 12, 2004

(30) Foreign Application Priority Data

May 13, 2002 (JP) ..... P.2002-137603

(51) Int. Cl.
*B41J 2/01* (2006.01)

(52) U.S. Cl. ..... 347/105; 347/103; 347/101; 428/32.1

(58) Field of Classification Search ..... 347/101, 347/103, 105, 100; 428/195, 32.1
See application file for complete search history.

(56) References Cited

U.S. PATENT DOCUMENTS

| | | | | |
|---|---|---|---|---|
| 5,397,763 | A * | 3/1995 | Fujimura et al. | 156/235 |
| 2002/0059978 | A1 * | 5/2002 | Nagata et al. | 428/411.1 |
| 2003/0076395 | A1 * | 4/2003 | Onishi et al. | 347/101 |

FOREIGN PATENT DOCUMENTS

| | | |
|---|---|---|
| JP | 60-23096 | 2/1985 |
| JP | 60-189486 | 9/1985 |
| JP | 61-230973 | 10/1986 |
| JP | 8-174989 | 7/1996 |

* cited by examiner

*Primary Examiner*—Manish S. Shah
(74) *Attorney, Agent, or Firm*—Ladas and Parry LLP

(57) ABSTRACT

The invention provides a protective layer-transferring film for ink jet having a transferable protective layer which is relasably formed on a heat-resistant film and which is to be heat transferred onto recorded matter having thereon an image formed by an ink jet recording system, in which the transferable protective layer is formed from a plurality of aqueous resin emulsions different in minimum film-forming temperature.

10 Claims, 1 Drawing Sheet

PROTECTIVE LAYER-TRANSFERRING FILM FOR INK JET RECORDED MATTER

FIELD OF THE INVENTION

The present invention relates to a protective layer-transferring film for ink jet which coats an image of ink jet recorded matter formed by an ink jet recording system with a protective layer capable of improving its gloss, image quality, keeping quality and the like.

BACKGROUND OF THE INVENTION

The ink jet recording system is a printing system in which ink droplets are discharged through minute jet nozzles of a recording head according to image data, and allowed to adhere to a recording medium, thereby making a print By the recent innovative progress of the ink jet recording technology, ink jet recorded matter of high gloss, high image quality and high keeping quality has come to be obtained, but has not reached a level comparable to silver salt photographs under the present circumstances. Recently, in order to achieve high keeping quality comparable to silver salt photographs, pigment inks excellent in water resistance, light resistance and the like compared to dye inks have come to be used as inks for ink jet recording.

As the technical problem of ink jet recording using the pigment inks, there has been the problem that so-called uneven gloss occurs, particularly when highly lustrous media are used as the recording media. The uneven gloss is a phenomenon in which the difference in gloss occurs between a background area (a non-print area on which the gloss of the medium itself appears) and a print area, between a plurality of colors even in the print area, or between light and shade even in the same color Further, recorded matter on which an image is formed by the pigment ink (pigment ink recorded matter) also has the problem of poor sharpness in visual observation, compared to silver salt photographs. Furthermore, the image of the pigment ink recorded matter is formed by pigment particles adhered to a surface layer of the recorded matter, so that the image is sometimes separated or stained when rubbed against another object. A problem is therefore encountered with regard to abrasion resistance in many cases.

As a process for solving such problems of the pigment ink recorded matter, it is conceivable to form a resin layer such as a transparent film or the like on the surface of the image formed. As for this resin layer formation process, a large number of methods have been proposed mainly for dye ink recorded matter, and a method of melt laminating polyethylene or polypropylene, a method of laminating a polyethylene film or a polypropylene film by bonding, and the like are well known. However, in these laminating methods the resin layer must be thickened to some extent in order to impart thereto such adhesiveness or adhesion that does not develop a so-called pinhole and that does not cause separation from the surface of the image under ordinary use conditions. However, the resin layer having such a thickness has the problems of deteriorating image quality, causing uncomfortable dazzling, developing curl, and the like.

As an improved technique of the above-mentioned laminating methods, JP-A-60-23096 (the term "JP-A" as used herein means an "unexamined published Japanese patent application"), JP-A-60-189486 and JP-A-61-230973 disclose a method of using a protective layer-transferring film comprising a film and a protective layer (resin layer) relesably provided thereon, and heat transferring the protective layer onto the surface of an image of recorded matter, thereby easily providing the protective layer on the image. Further, JP-A-8-174989 discloses a method of providing on recorded matter a transfer overcoat layer melt transferred via a heat-resistant film and mainly composed of a thermoplastic resin. According to the heat transfer methods using such protective layer (resin layer)-transferring films, it becomes possible to form thin resin layers, compared to the above-mentioned laminating methods. Accordingly, the uneven gloss of the pigment ink recorded matter, and poor image sharpness and abrasion resistance can be solved without bringing about deteriorated image quality.

The conventional protective layer-transferring film for the heat transfer method on which the transferable protective layer is relesably formed on the heat-resistant film has the problem that transfer easiness of the protective layer to the recorded matter is so pursued that adhesion between the heat-resistant film and the transferable protective layer becomes insufficient, which causes separation or dropout of the transferable protective layer from the heat-resistant film in slitting or in a heat transfer operation. On the other hand, the transferable protective layer excellent in adhesion to the heat-resistant film poses the problem of poor gloss-imparting effect to the recorded matter, and no protective layer-transferring film excellent in both the transfer easiness and gloss-imparting effect has been provided yet. Further, the conventional protective layer-transferring film also has the problem that so-called blocking occurs in which a sticky surface of the transferable protective layer comes into contact with and sticks to a back side of the heat-resistant film, and the transferable protective layer is transferred to the back side in an extreme case, when the protective layer-transferring film is wound up and stored in the roll form, because the transferable protective layer deteriorates with time to make the surface thereof sticky in some cases.

SUMMARY OF THE INVENTION

It is therefore an object of the invention to provide a protective layer-transferring film for ink jet which can form a high-glossy protective layer on the surface of an image of recorded matter without deteriorating original image quality, feeling and the like of the ink jet recorded matter, particularly pigment ink recorded matter, and is also excellent in adhesion between a heat-resistant film and a transferable protective layer, transfer easiness of the transferable protective layer to the recorded matter, blocking resistance and keeping quality with time.

Other objects and effects of the invention will become apparent from the following description.

The present inventors variously studied protective layer-transferring films for ink jet recorded matter suitable for the heat transfer method. As a result, it was found that by forming a transferable protective layer constituting a protective layer-transferring film from a plurality of aqueous resin emulsions different in minimum film-forming temperature, preferably from at least one aqueous resin emulsion having a minimum film-forming temperature of 50° C. or more and at least one aqueous resin emulsion having a minimum film-forming temperature of less than 50° C., both the transfer easiness and high gloss-imparting effects can be attained at the same time, and the obtained protective layer-transferring film is also excellent in keeping quality with time.

The invention has been made based on the above-mentioned finding, and the above-mentioned objects have been achieved by providing a protective layer-transferring film for ink jet having a transferable protective layer which is releasably formed on a heat-resistant film and which is to be heat transferred onto recorded matter having thereon an image formed by an ink jet recording system, wherein the transferable protective layer is formed from a plurality of aqueous resin emulsions different in minimum film-forming temperature.

DETAILED DESCRIPTION OF THE INVENTION

The protective layer-transferring film for ink jet (hereinafter also referred to as the transfer film) of the invention will be described in detail below.

Figure 1:
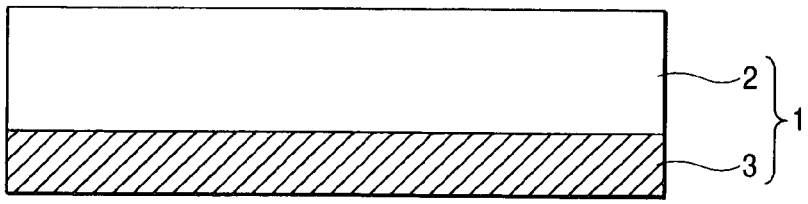
FIG. 1 is a schematic cross sectional view showing one embodiment of a transfer film of the invention.

FIG. 1 is a schematic cross sectional view showing one embodiment of a transfer film of the invention. This transfer film comprises a heat-resistant film 2 and a transferable protective layer 3 which is releasably formed on the heat-resistant film 2 and which is to be heat transferred onto recorded matter having thereon an image formed by an ink jet recording system.

As the heat-resistant film 2, there is used one having such heat resistance that a shape can be stably maintained under specific heating and pressurizing conditions in heat transfer. Specifically, a film of a resin such as a polyethylene terephthalate (PET), a polyester, a polyethylene naphthenate (PEN), a polyamine, a polyamide, a polypropylene or a polymethylpentene (TPX); metal foil such as aluminum foil; an aluminum-deposited film, an aluminum foil-laminated film or the like is preferably used. The resin film is preferably one comprising a resin having a higher softening point than a resin constituting the transferable protective layer 3.

Taking into account thermal conductivity in heat transfer and adhesion between the transferable protective layer 3 and the surface of the recorded matter, it is preferred that the thickness of the heat-resistant film 2 is as thin as possible. However, too thin a thickness is unfavorable, because not only handling becomes difficult, but also there is the possibility of wrinkles appearing in the transferable protective layer 3 or bubbles entering between the transferable protective layer 3 and the printed matter. From such a viewpoint, the thickness of the heat-resistant film 2 is preferably from 3 to 50 μm, and more preferably from 10 to 30 μm.

The heat resistance of the heat-resistant film 2 can be further enhanced as needed by incorporating fine ceramic particles into the heat-resistant film 2, or by coating the surface thereof with a heat-resistant resin such as a polyester resin, a polyacrylic acid ester resin, a poly(vinyl acetate) resin, a polyurethane resin, a styrene-acrylate resin, a poly acrylate resin, a polyacrylic resin, a polyamide resin, a polyether resin, a polystyrene resin, a polyethylene resin, a polypropylene resin, a polyolefin resin, a vinyl resin such as a poly(vinyl chloride) resin or a poly(vinyl alcohol) resin, a celulosic resin such as a cellulose resin, a hydroxyethyl cellulose resin or a cellulose acetate resin, a poly(vinyl acetal) resin such as a poly(vinyl acetoacetal) resin or a poly(vinyl butyral) resin, a silicone-modified resin or a long chain alkyl-modified resin. Further, it is also possible to improve the transfer easiness, the prevention of the adhesion of dust due to static electricity, and the design of the surface of the transferable protective layer by applying various surface treatment methods such as release treatment using a silicone, antistatic treatment, corona discharge treatment and emboss treatment to the surface of the heat resistant film 2 on which the transferable protective layer 3 is formed.

The transferable protective layer 3 is formed from a plurality of aqueous resin emulsions different in minimum film-forming temperature (in accordance with JIS K6800, hereinafter referred to as MFT). The aqueous resin emulsion is a resin dispersion using a resin as a dispersoid and water as a main disperse medium, and the resin is homogeneously dispersed in the disperse medium in the form of approximately spherical fine resin particles.

In particular, the transferable protective layer 3 is preferably formed from at least one aqueous resin emulsion having an MFT of 50° C. or more, preferably 50 to 250° C., more preferably 60 to 150° C. (hereinafter referred to as a first emulsion) and at least one aqueous resin emulsion having an MFT of less than 50° C., preferably less than 45° C., more preferably less than 40° C. (hereinafter referred to as a second emulsion). The first emulsion and the second emulsion are used as a mixture thereof.

The glass transition temperature (Tg) of the resin in the above-mentioned first emulsion is preferably from 20 to 150° C., more preferably from 30 to 120° C., and still more preferably from 40 to 100° C., from the viewpoints of adjusting the MFT to the above-mentioned specific range and imparting good transfer properties, heat resistance, coating strength and the like to the transferable protective layer 3. Further, from the same viewpoints, the Tg of the resin in the above-mentioned second emulsion is preferably from −50 to 40° C., more preferably from −40 to 40° C., and still more preferably from −30 to 30° C. Thus, the transferable protective layer according to the invention formed from a plurality of aqueous resin emulsions different in MFT is formed from a plurality of resins different in Tg, and the range of each Tg is as described above.

The blending ratios of the above-mentioned first emulsion and the above-mentioned second emulsion can be appropriately adjusted according to levels required for adhesion and transfer easiness of the transferable protective layer 3 to the heat-resistant film 2, gloss feeling and blocking resistance of a protective layer at the time when the transferable protective layer 3 is heat transferred onto the recorded matter to form the protective layer, and the like. When it is desired that these respective characteristics be exhibited in a good balance, the content of the first emulsion-derived resin in the transferable protective layer 3 (when the first emulsion comprises two or more kinds of emulsions, the total amount thereof) is preferably 20% by weight or more, and more preferably from 20 to 50% by weight. When the content of the first emulsion-derived resin is less than 20% by weight, there is the possibility that sufficient improving effects are not obtained, particularly in blocking resistance and gloss feeling. Further, the content of the second emulsion-derived resin in the transferable protective layer 3 (when the second emulsion comprises two or more kinds of emulsions, the total amount thereof) is preferably 80% by weight or less, and more preferably from 50 to 80% by weight. When the content of the second emulsion-derived resin exceeds 80% by weight, there is the possibility that blocking resistance deteriorates.

As the above-mentioned aqueous resin emulsion, there is used one having such heat transfer properties, heat resistance, transparency, adhesion to the heat-resistant film 2 that they are required for a layer to be heat transferred, and being capable of forming a coating having chemical and physical barrier properties. Preferred examples of the aqueous resin emulsions include one using as a dispersoid at least one selected from the group consisting of an acrylic copolymer, an acrylic-styrene copolymer, a vinyl acetate resin, a vinyl acetate copolymer, a vinyl chloride-vinyl acetate copolymer, a vinyl chloride-acrylic copolymer, a vinyl acetate-acrylic copolymer and an acrylic-silicone copolymer. In particular, from the viewpoints of transfer easiness and adhesion, the aqueous resin emulsion using an acrylic copolymer and/or an acrylic-styrene copolymer as a dispersoid is preferably used.

Figure 2:
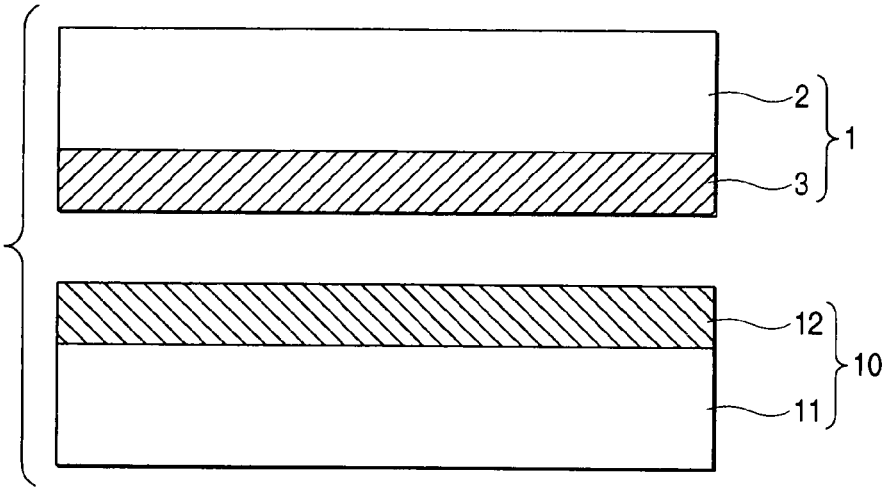
FIGS. 2(*a*) to 2(*c*) are schematic views for illustrating protective layer formation steps by a heat transfer method using the transfer film shown in FIG. 1.
Figure 2:
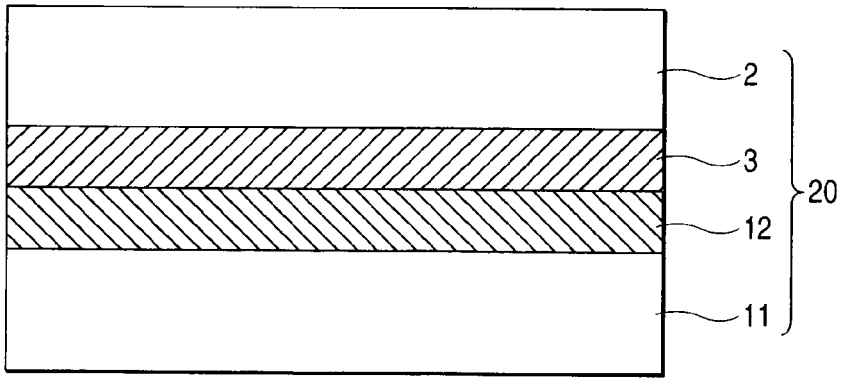
Figure 2:
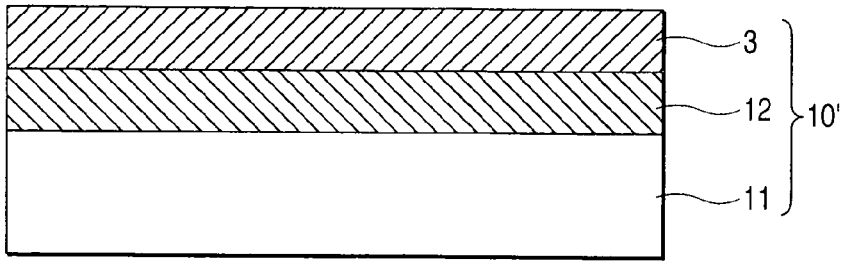

The above-mentioned aqueous resin emulsion is obtained by polymerizing radically polymerizable monomers in water in the presence of an emulsifier and a polymerization initiator. Examples of the monomers include the followings:

(Cyclo) alkyl (meth)acrylates such as methyl (meth)-acrylate, ethyl (meth)acrylate, n-propyl (meth)acrylate, i-propyl (meth)acrylate, n-butyl (meth)acrylate, i-butyl (meth)acrylate, sec-butyl (meth)acrylate, t-butyl (meth)-acrylate, n-amyl (meth)acrylate, i-amyl (meth) acrylate, n-hexyl (meth)acrylate, 2-ethylhexyl (meth) acrylate, n-octyl (meth)acrylate or cyclohexyl (meth) acrylate;

Alkoxyl(cyclo)alkyl (meth)acrylates such as 2-methoxy-ethyl (meth)acrylate, 2-ethoxyethyl (meth)acrylate, 2-methoxypropyl (meth)acrylate, 3-methoxypropyl (meth)-acrylate, 2-methoxybutyl (meth)acrylate, 3-methoxybutyl (meth)acrylate, 4-methoxybutyl (meth)acrylate or p-methoxycyclohexyl (meth)acry-late;

N-methylolated unsaturated carboxylic acidamides such as N-methylol(meth)acrylamide or N,N-dimethylol (meth)acrylamide;

Vinyl esters such as vinyl acetate, vinyl propionate or vinyl versatate;

Fluoroalkyl (meth)acrylates such as perfluoroethyl (meth) acrylate, perfluoropropyl (meth)acrylate or penta-de-cafluorooctyl (meth)acrylate;

Aminoalkyl group-containing (meth)acrylates such as 2-dimethylaminoethyl (meth)acrylate, 2-diethylamino-ethyl (meth)acrylate, 2-dimethylaminopropyl (meth) acrylate or 3-dimethylaminopropyl (meth)acrylate;

Aminoalkyl group-containing acrylamides such as 2-dim-ethylaminoethylacrylamide, 2-diethylaminoethylacryl-amide, 2-dimethylaminopropylacrylamide or 3-dim-ethylamino-propylacrylamide;

Aminoalkoxyalkyl group-containing (meth)acrylates such as 2-(dimethylaminoethoxy)ethyl (meth)acrylate, 2-(diethylaminoethoxy)ethyl (meth)acrylate or 3-(dim-ethyl-aminoethoxy)propyl (meth)acrylate;

Multifunctional (meth)acrylates such as ethylene glycol di(meth)acrylate, diethylene glycol di(meth)acrylate, triethylene glycol di(meth)acrylate, tetraethylene gly-col di(meth)acrylate, propylene glycol di(meth)acry-late, dipropylene glycol di(meth)acrylate, tripropylene glycol di(meth)acrylate, tetrapropylene glycol di(meth) acrylate, 1,4-butanediol di(meth)acrylate, 1,6-hex-anediol di(meth)acrylate, neopentyl glycol di(meth) acrylate, 2,2'-bis[4-(meth)acryloxypropoxyphenyl] propane, 2,2'-bis[4-(meth)acryloxydiethoxyphenyl] propane, glycerol tri(meth)acrylate, trimethylolpropane tri(meth)acrylate or pentaerythritol tetra(meth)acrylate;

the laminated sheet 20, thereby obtaining recorded matter 10' with a protective layer in which the protec-tive layer 3 is formed on the ink receiving layer 12 (see FIG. 2(*c*))

Aromatic vinyl compounds such as styrene, α-methyl-styrene, 2-methylstyrene, 3-methylstyrene, 4-methyl-styrene, 4-ethylstyrene, 4-t-butylstyrene, 3,4-dimethyl-styrene, 4-methoxystyrene, 4-ethoxystyrene, 2-chlorostyrene, 3-chlorostyrene, 4-chlorostyrene, 2,4-dichlorostyrene, 2,6-dichlorostyrene, 4-chloro-3-meth-ylstyrene, divinylbenzene, 1-vinylnaphthalene, 2-vi-nylpyridine or 4-vinylpyridine;

Cyano group-containing unsaturated monomers such as (meth)acrylonitrile, crotononitrile, 2-cyanoethyl (meth)-acrylate, 2-cyanopropyl (meth)acrylate, 2-cy-anopropyl (meth)acrylate or cinnamoyl nitrile;

Carboxyl group-containing unsaturated monomers or anhydrides thereof such as (meth)acrylic acid, crotonic acid, cinnamic acid, maleic acid, maleic anhydride, fumaric acid, itaconic acid, monomethyl maleate, monoethyl maleate, monomethyl itaconate, monoethyl itaconate or mono-2-(meth)acryloyloxyethyl hexahy-drophthalate;

Vinyl halide compounds such as vinyl chloride, vinylidene chloride or a fatty acid vinyl ester;

Conjugated dienes such as 1,3-butadiene, isoprene, chlo-roprene or 2,3-dimethyl-1,3-butadiene;

Polymerizable silicones such as γ-(meth)acryloxy-propy-ltrimethoxysilane or Silaplaine FMO711 (trade name) manufactured by Chisso Corporation;

Ultraviolet ray-absorbing functional group-containing (meth)acrylates such as 2-(2'-hydroxy-5'-meth-acry-loxyethylphenyl)-2H-benzotriazole or 2-(2'-hydroxy-5'-methacryloxyethyl-3'-t-butylphenyl)-2H-benzotriaz-ole; and Photostabilizing group-containing (meth)acrylates such as 1,2,2,6,6-pentamethyl-4-piperidyl (meth)acrylate or 2,2,6,6-tetramethyl-4-piperidyl (meth)acrylate.

Although there is no particular limitation on the polymer-ization method of the above-mentioned monomer as long as a polymer formed is dispersed in an aqueous medium as particles, emulsion polymerization is preferred.

When the emulsion polymerization is conducted, various emulsifiers, polymerization initiators, chain transfer agents, electrolytes, pH adjusting agents and the like are used in combination with the above-mentioned monomers. Small amounts of solvents can also be used within the range that workability, disaster prevention safety, environmental safety and production safety are not impaired. As the emulsifier, there is usable, for example, an anionic surfactant, a non-ionic surfactant, a cationic surfactant, an amphoteric surfac-tant, a water-soluble polymer other than a hydroxyl group-containing water-soluble polymer, or the like.

The emulsion polymerization is preferably conducted under such conditions that the polymerization conversion ratio reaches 95% or more. For example, using 100 to 1000 parts by weight of water based on 100 parts by weight of the monomer, together with the emulsifier and the polymeriza-tion initiator, the emulsion polymerization can be conducted under conditions of a polymerization temperature of 5 to 100° C., preferably 40 to 90° C., and a polymerization time of 01 to 10 hours.

As a polymerization system, there can be employed a batch system, a system of adding the monomer dividedly or continuously, a system of adding a pre-emulsion of the monomer dividedly or continuously, a system in which these systems are combined stepwise, or the like. When the monomer having low water solubility is used, it is preferred that the emulsifier, the ethylenically unsaturated monomer and water are previously forcedly emulsified with a high-pressure homogenizer or an ultrasonic dispersing device to prepare a pre-emulsion, which is subjected to the batch polymerization system or the system of adding the monomer dividedly or continuously.

As the above-mentioned aqueous resin emulsions, commercially available ones are also usable. For example, there are preferably used EX-40 and EX-35 (acrylic-styrene copolymer emulsions manufactured by Nippon Shokubai Co., Ltd.); 5391, EC-880, 5410, 9470, 3983 and 5450 (acrylic-styrene copolymer emulsions manufactured by Dainippon Ink & Chemicals, Inc.); 972, 870 and 928 (acrylic-styrene copolymer emulsions manufactured by Clariant Polymers K. K.); 2598, 2778, 2647 and 2650 acrylic copolymer emulsions manufactured by Nisshin Chemical Industry Co., Ltd.); 660 and 520 (vinyl chloride copolymer emulsion manufactured by Nisshin Chemical Industry Co., Ltd.); and the like.

The transferable protective layer 3 may contain one or two or more of various additives such as a dye, a pigment, a release agent, a lubricant, an antifoaming agent, a dispersing agent, an antistatic agent, an ultraviolet ray-absorbing agent, an antioxidant, a fluorescent dye and a fluorescent whitening agent, as needed, as well as the above-mentioned aqueous resin emulsions.

The above-mentioned pigments include, for example, inorganic particles such as silica, calcium carbonate, kaolin clay, barium sulfate and titanium oxide. The blocking resistance of the protective layer can be further improved by allowing the transferable protective layer 3 to contain such inorganic particles.

Further, the above-mentioned release agents include, for example, a solid wax such as polyethylene wax or amide wax, a surfactant such as a phosphoric ester, and a fluorine or silicone compound such as silicone oil, Teflon (registered trade mark) powder or silicone powder. The blocking resistance of the recorded matter to which the transferable protective layer 3 is transferred or the transfer film in the roll form can be further improved by allowing the transferable protective layer 3 to contain such a release agent. However, when the content is high, there is the possibility that the adhesion or image density may be deteriorated. It is therefore preferred that it is only added in extremely small amounts.

Taking into account thermal conductivity and adhesion to the surface of the recorded matter in heat transfer, it is preferred that the thickness of the transferable protective layer 3 is as thin as possible. However, too thin a thickness is unfavorable, because not only the gloss-imparting effect is poor, but also there is the possibility of wrinkles appearing in the transferable protective layer 3 or bubbles entering between the transferable protective layer 3 and the printed matter. From such a viewpoint, the thickness of the transferable protective layer 3 is preferably from 2 to 50 μm, and more preferably from 5 to 25 μm. The transferable protective layer 3 scarcely changes in thickness, even when heat transferred onto the recorded matter to form the protective layer, and the thickness of the protective layer is approximately within the above-mentioned range.

The transfer film 1 can be produced by mixing the above-mentioned plurality of aqueous resin emulsions with the above-mentioned various additives as needed to prepare a coating solution, and applying this coating solution to the heat-resistant film 2, followed by drying to form the transferable protective layer 3 on the heat-resistant film 2. Although the transferable protective layer 3 is usually formed on the whole surface of the heat-resistant film 2, it may be formed on a part of the heat-resistant film 2. The coating solution can be applied with various coating apparatus such as a blade coater, a die coater, a reverse roll coater, a gravure roll coater, an air knife coater, a bar coater, a rod blade coater, a curtain coater, a short dowel coater, a size press and a spray.

The transfer film of the invention can be used in the same manner as with the heat transfer film of this kind, and the protective layer can be easily formed on the recorded matter with relatively simple equipment.

FIGS. 2(*a*) to 2(*c*) are schematic views for illustrating protective layer formation steps by a heat transfer method using the transfer film 1 shown in FIG. 1. In this embodiment, as the recorded matter, there is used ink jet recorded matter 10 in which an ink receiving layer 12 mainly composed of porous inorganic particles such as silica or alumina is formed on a substrate 11 formed from paper or a film, with an image (not shown) formed on the ink receiving layer 12 by an ink jet recording system. However, the scope of application of the transfer film of the invention should not be construed as being limited to the ink jet recorded matter 10.

First, the transfer film 1 is superposed on the ink jet recorded matter 10 so that the transferable protective layer 3 and the ink receiving layer 12 face to one another to form a laminated sheet 20 (see FIG. 2(*b*)). Then, this laminated sheet 20 is heated and pressurized with a known heating and pressurizing apparatus such as a heat roller, a thermal head or an iron to press the transferable protective layer 3 on the ink receiving layer 12. The heating temperature is preferably from 50 to 200° C., and more preferably from 80 to 150° C. When the temperature of the laminated sheet 20 is lowered to some degree to securely press the transferable protective layer 3 on the surface of the ink receiving layer 12, only the heat-resistant film 2 is separated from the laminated sheet 20, thereby obtaining recorded mater 10' with a protective layer in which the protective layer 3 is formed on the ink receiving layer 12 (see FIG. 2(*c*)).

The transfer film of the invention is used in the manner described above to the recorded matter (ink jet recorded matter) in which the image is formed by the ink jet recording system, thereby sufficiently exhibiting its effect. The transfer film of the invention can be used to any ink jet recorded matter, and is also applicable to coated paper for general printing (coated paper in which no ink jet aptitude is taken into consideration) such as art paper and coated paper, and non-coated paper such as plain paper, quality paper and recovered paper, as well as so-called ink jet recording paper as shown in FIG. 2. The ink jet recording paper is one used when an image having particularly high image quality is required, and generally has the constitution that an ink receiving layer mainly composed of porous inorganic particles is provided on a substrate such as paper or a film. As the porous inorganic particles, there are preferably used porous amorphous silica, porous magnesium carbonate, porous alumina and the like, and the content thereof is from about 40 to about 90% by weight in the ink receiving layer. In order to secure necessary coating strength, a binder such as polyvinyl alcohol is usually also contained in the ink receiving layer. Although the ink jet recording paper is classified into groups such as matte paper, semi-glossy paper, glossy paper and high-glossy paper, according to texture, feeling and surface properties of the ink receiving layer, the transfer film of the invention is applicable to any ink jet recording paper.

Further, the above-mentioned ink jet recorded matter may be dye ink recorded matter in which an image is formed by dye ink, or pigment ink recorded matter in which an image is formed by pigment ink. In particular, the pigment ink recorded matter is generally excellent in heat resistance, water resistance and the like of the recorded image, compared to the dye ink recorded matter, so that it becomes possible to obtain recorded matter excellent in long-term keeping quality by further forming the protective layer by use of the transfer film of the invention. Although the dye ink or pigment ink for ink jet recording is generally one in which water is allowed to contain a colorant such as a dye or a pigment, usually, various organic solvents, surfactants and the like are further contained for moisture retention and moisture permeability adjustment. When a color image is formed, an ink of three subtractive primary colors of yellow, magenta and cyan or an ink of four or more colors in which black and other color inks are added to the above is used.

Various modifications can be made without departing from the spirit of the invention, as long as the protective layer-transferring film for ink jet of the invention has the transferable protective layer which is releasably formed on the heat-resistant film and which is to be heat transferred onto the recorded matter having thereon an image formed by the ink jet recording system, and the transferable protective layer is formed from a plurality of aqueous resin emulsions different in minimum film-forming temperature. For example, the transferable protective layer is not restricted to a single-layer structure formed from one kind of a coating solution, such as the embodiment shown in FIG. 1, but may have a multilayer structure obtained by applying plural kinds of coating solutions, one over another. In the case of the multilayer structure, the layers constituting the multilayer are each formed from a plurality of aqueous resin emulsions different in minimum film-forming temperature.

Further, in order to improve transfer properties of the transferable protective layer, a release layer mainly composed of colloidal silica or the like and having a thickness of about 0.5 to about 5 μm may be provided between the heat-resistant film and the transferable protective layer.

On the back side (the side on which no transferable protective layer is provided) of the heat-resistant film, a heat-resistant slip layer can also be provided for the purposes of preventing fusing to the heating and pressurizing apparatus such as the heat roll, improving blocking resistance, improving slippage of the transfer film in paper feed, and the like purpose. The heat-resistant slip layer can be formed by applying a silicone resin or the like, and the thickness thereof is usually from about 0.1 to about 10 μm.

EXAMPLES

The present invention will be illustrated in greater detail with reference to the following Examples, but the invention should not be construed as being limited thereto.

EXAMPLES 1 TO 9 AND COMPARATIVE EXAMPLES 1 TO 3

A coating solution prepared by mixing a plurality of aqueous resin emulsions was applied onto the whole surface of one side of a PET film (heat-resistant film) in a uniform amount by use of a wire bar, and dried to form a transferable protective layer on the PET film. Thus, a plurality of transfer films different in transferable protective layer composition were produced, and these were taken as respective samples of Examples 1 to 9 and Comparative Examples 1 to 3. The thicknesses of the PET films and the transferable protective layers, aqueous resin emulsions used and content ratios (weight ratios of solid matter) thereof, in the respective samples, are shown in the following Table 1.

TABLE 1

| | Thickness of | Transferable Protective Layer | | | | |
|---|---|---|---|---|---|---|
| | Heat-Resistant Film | Thickness | First Emulsion | Second Emulsion | | Content Ratio (First/Second/Second) |
| Example 1 | 25 μm | 15 μm | 2647 (80° C./78° C.) | 2650 (0° C./−34° C.) | — | 40/60 |
| Example 2 | 16 μm | 20 μm | 5391 (60° C. or more/78° C.) | EC-880 (29° C./26° C.) | 5410 (10° C./8° C.) | 25/50/25 |
| Example 3 | 16 μm | 15 μm | 9470 (60° C. or more/47° C.) | 3983 (25° C./21° C.) | 5450 (20° C./12° C.) | 30/50/20 |
| Example 4 | 50 μm | 15 μm | 2647 (80° C./78° C.) | 2650 (0° C.1/−34° C.) | — | 40/60 |
| Example 5 | 25 μm | 3 μm | 2647 (80° C./78° C.) | 2650 (0° C./−34° C.) | — | 40/60 |
| Example 6 | 25 μm | 30 μm | 2647 (80° C./78° C.) | 2650 (0° C./−34° C.) | — | 40/60 |
| Example 7 | 25 μm | 15 μm | 660 (100° C./−) | 520 (0° C./−34° C.) | — | 30/70 |
| Example 8 | 25 μm | 15 μm | 9470 (60° C. or more/47° C.) | 5450 (20° C./12° C.) | — | 10/90 |
| Example 9 | 25 μm | 15 μm | 3983 (25° C./21° C.) | 5450 (20° C./12° C.) | — | 70/30 |
| Comparative Example 1 | 25 μm | 15 μm | 3983 (25° C./21° C.) | — | — | 100 |
| Comparative Example 2 | 25 μm | 15 μm | 660 (100° C./−) | — | — | 100 |
| Comparative Example 3 | 25 μm | 15 μm | 5391 (60° C. or more/78° C.) | — | — | 100 |

*In Table 1, numerical values in parentheses indicate the minimum film-forming temperature/the resin component's glass transition temperature.

2647, 2650: Acrylic copolymer emulsions manufactured by Nisshin Chemical Industry Co., Ltd.

5391, EC-880, 5410, 9470, 3983, 5450: Acrylic-styrene copolymer emulsions manufactured by Dainippon Ink & Chemicals, Inc.

660, 520: Vinyl chloride copolymer emulsions manufactured by Nisshin Chemical Industry Co., Ltd.

Preparation of Ink Jet Recorded Matter

A natural image was printed on an ink receiving layer of commercial MC matte paper (KA450MM manufactured by Seiko Epson Corporation) by use of a pigment ink jet printer (trade name "MC2000", manufactured by Seiko Epson Corporation) to prepare ink jet recorded matter.

For the respective transfer films of Examples 1 to 9 and Comparative Examples 1 to 3, blocking resistance, adhesion, transfer properties and gloss feeling were each evaluated according to the following methods. The results thereof are shown in Table 2.

Evaluation Method of Blocking Resistance

For each transfer film, two sheets of the A4 size were prepared, and these two sheets were overlapped so that the transferable protective layer of one of the sheets and the PET film of the other sheet faced to each another, followed by standing for 24 hours under conditions of a room temperature of 50° C. and a relative humidity of 60% with a load of 300 g/cm$^2$ applied from above. Then, the two sheets overlapped were separated at a separating angle (an angle between the transferable protective layer and the PET film facing to each another) of 130 degrees at a separating speed of 30 cm/min. The state of faces overlapped was visually observed and evaluated according the following evaluation criteria:

<Evaluation Criteria>

A: Transfer of the transferable protective layer to the PET film is not observed at all. The blocking resistance is good.

B: The transferable protective layer is partly transferred to the PET film, but there is practically no problem.

C: The transferable protective layer is largely transferred to the PET film, and the transfer film is of no practical use.

Evaluation Method of Adhesion

The surface of the transferable protective layer of each transfer film was cross cut (10×10 number of 2 millimeters squares) in accordance with JIS-K5600-5-6. After an adhesive tape was adhered to the cross-cut surface, the adhesive tape was peeled off. The case that the number of remaining squares on the heat-resistant film without being taken by the adhesive tape peeled off was from 80 to 100 was evaluated as A (good in adhesion), the case that the number of remaining squares was from 40 to 79 was evaluated as B (practically no problem), and the case that the number of remaining squares was 39 or less was evaluated as C (of no practical use).

Evaluation Method of Transfer Properties

Each of the above-mentioned transfer films was placed on the above-mentioned ink jet recorded matter so that the transferable protective layer came to contact with the surface of the image, and passed through a pair of heat rolls to conduct heat and pressurization treatment at a heating temperature of 100° C. at a line pressure of 8 N/m, thereby pressing the transferable protective layer on the whole surface of the image to produce press-laminated matter. The heat-resistant film was separated from this press-laminated matter at a separating angle (an angle between the heat-resistant film and the transferable protective layer) of 130 degrees at a separating speed of 30 cm/min, and evaluations were made according the following evaluation criteria:

<Evaluation Criteria>

A: Only the heat-resistant film can be easily separated, and a smooth and fine protective layer is formed on the ink jet recorded matter. The transfer properties are good.

B: In only a small part, poor transfer or air inclusion between a protective layer formed and the ink jet recorded matter is observed, but there is practically no problem.

C: Poorly transferred parts are remarkable, and the transfer film is of no practical use.

Evaluation Method of Gloss Feeling

In the above (the evaluation method of transfer properties), for the protective layer of the recorded matter with the protective layer obtained by separating the heat-resistant film from the press-laminated matter, the glossiness (%) at a reflection angle of 60 degrees was measured (in a sample having a poorly transferred part, the glossiness was measured for a part having no poor transfer) with a gloss meter, GM-3D (manufactured by Murakami Color Research Laboratory). A glossiness of 50% or more was evaluated as A, 30% to less than 50% as B, and less than 30% as C.

TABLE 2

| | Blocking Resistance | Adhesion | Transfer Properties | Gloss Feeling |
|---|---|---|---|---|
| Example 1 | A | A | A | A |
| Example 2 | A | A | A | A |
| Example 3 | A | A | A | A |
| Example 4 | A | A | B | A |
| Example 5 | A | A | B | B |
| Example 6 | A | A | B | A |
| Example 7 | A | B | B | A |
| Example 8 | B | A | A | B |
| Example 9 | B | A | A | B |
| Comparative Example 1 | C | A | B | C |
| Comparative Example 2 | A | C | C | A |
| Comparative Example 3 | A | B | C | A |

The protective layer-transferring film of the invention is excellent in transfer easiness of the transferable protective layer to the recorded matter and in gloss-imparting effect, so that the high-glossy ink jet recorded matter with the protective layer can be easily produced. Further, this protective layer-transferring film is also good in adhesion between the heat-resistant film and the transferable protective layer, blocking resistance, keeping quality with time, and the like, and excellent in handling ability.

While the invention has been described in detail and with reference to specific embodiments thereof, it will be apparent to one skilled in the art that various changes and modifications can be made therein without departing from the spirit and scope thereof.

The present invention is based on Japanese Patent Application No. 2002-137603 filed May 13, 2003, the content thereof being incorporated herein by reference.

What is claimed is:

1. A protective layer-transferring film for ink jet having a transferable protective layer which is releasably formed on a heat-resistant film and which is to be heat transferred onto recorded matter having thereon an image formed by an ink jet recording system, wherein the transferable protective layer has a thickness of 15 to 50 μm and is formed from a plurality of aqueous resin emulsions different in minimum film-forming temperature, said plurality of aqueous resin emulsions comprising at least a first resin emulsion and a second resin emulsion, wherein said first resin emulsion comprises a resin with a glass transition temperature (Tg) of from 21 to 78° C., and said second resin emulsion comprises a resin with a glass transition temperature (Tg) that is lower than the glass transition temperature (Tg) of the resin of the first resin emulsion.

2. The protective layer-transferring film for ink jet according to claim 1, wherein the first resin emulsion has a minimum film-forming temperature of 50° C. or more, and the second resin emulsion has a minimum film-forming temperature of less than 50° C.

3. The protective layer-transferring film for ink jet according to claim 2, wherein the content of the resin derived from the first resin emulsion having a minimum film-forming temperature of 50° C. or more in the transferable protective layer is 20% by weight or more.

4. The protective layer-transferring film for ink jet according to claim 2, wherein the content of the resin derived from the second resin emulsion having a minimum film-forming temperature of less than 50° C. in the transferable protective layer is 80% by weight or less.

5. The protective layer-transferring film for ink jet according to claim 1, wherein the plurality of aqueous resin emulsions are aqueous emulsions using an acrylic copolymer and/or an acrylic-styrene copolymer as a dispersoid.

6. The protective layer-transferring film for ink jet according to claim 1, wherein the heat-resistant film comprises any one of a polyethylene terephthalate, a polyester, a polyethylene naphthalate, a polyimide, a polyamide, a polypropylene and a polymethylpentene.

7. The protective layer-transferring film for ink jet according to claim 1, wherein the heat-resistant film has a thickness of from 3 to 50 μm.

8. The protective layer-transferring film for ink jet according to claim 1, wherein the recorded matter is pigment ink recorded matter on which an image is formed by a pigment ink.

9. The protective layer-transferring film for ink jet according to claim 3, wherein the content of the resin derived from the second resin emulsion having a minimum film-forming temperature of less than 50° C. in the transferable protective layer is 80% by weight or less.

10. The protective layer-transferring film for ink jet according to claim 1, wherein the transferable protective layer has a thickness from 15 μm to 30 μm.

* * * * *